US006010232A

United States Patent [19]

Chen

[11] Patent Number: 6,010,232

[45] **Date of Patent: *Jan. 4, 2000**

[54] LAMP HOLDER ASSEMBLY

[76] Inventor: Franks Chen, 8F-6, No. 100, Sec. 2, Hoping E. Road, Taipei, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,764

[22] Filed: May 29, 1996

[51] Int. Cl.[7] ..... F21S 1/12

[52] U.S. Cl. ..... 362/287; 362/413; 362/427; 362/414

[58] Field of Search ..... 362/433, 413, 362/414, 287, 427, 419, 418

[56] References Cited

U.S. PATENT DOCUMENTS

| | | | |
|---|---|---|---|
| 2,240,659 | 5/1941 | McKinnie | 362/433 |
| 2,267,208 | 12/1941 | McKay | 362/433 |
| 2,354,154 | 7/1944 | Steber | 362/433 |
| 4,770,384 | 9/1988 | Kuwazima et al. | 362/413 |
| 4,974,135 | 11/1990 | Wen-tsung | 362/287 |
| 5,097,400 | 3/1992 | Cvek | 362/287 |
| 5,422,802 | 6/1995 | Lin | 362/413 |

*Primary Examiner*—Thomas M. Sember
*Attorney, Agent, or Firm*—Rosenberg, Klein & Lee

[57] ABSTRACT

A lamp holder assembly which includes a lampshade, a barrel fixedly secured to a hole in the lampshade, and a connector having a cylindrical front end revolvably mounted in the barrel and fixed in position by a tightening up screw and a rear coupling end turned about the coupling axle of a lamp support and fixed in position by a knob. A lamp socket is mounted in a chamber inside the connector to hold a lamp bulb outside the connector within the lampshade. The lamp socket has two retaining grooves at two opposite sides respectively forced into engagement with two retaining blocks inside the connector, and a switch mounted on the lamp socket within the connector. The switch has a switching button disposed outside the connector and adapted for switching on/off the electrical circuit of the lamp holder assembly.

1 Claim, 5 Drawing Sheets

LAMP HOLDER ASSEMBLY

BACKGROUND OF THE INVENTION

The present invention relates to lamps, and relates more particularly to a lamp holder assembly which can be conveniently adjusted to the desired angle relative to the lamp support.

The lamp holder assembly of for example a desk lamp is generally comprised of a lampshade, a lamp socket, a switch, a lamp support connector, etc. Because these parts are connected to one another by screws, they cannot be conveniently disconnected from one another for repair work. Furthermore, the lamp holder can only be adjusted to change its angle of inclination relative to the lamp support. If the lampshade is turned, the lamp bulb will be simultaneously rotated, causing the electrical wire to be twisted.

SUMMARY OF THE INVENTION

The present invention provides a lamp holder assembly which eliminates the aforesaid problems. According to the present invention, the lamp holder assembly comprises a lampshade having a coupling hole in the periphery; a connector having a cylindrical front end, an annular groove around the periphery of the cylindrical front end, a rear mounting hole adapted for pivoting to a lamp support, a lamp socket chamber adapted for holding a lamp socket, a wire hole adjacent to the rear mounting hole, two retaining blocks disposed inside the lamp socket chamber at different elevations, and a button hole; a lamp socket mounted in the lamp socket chamber of the connector to hold a lamp bulb outside the connector within the lampshade, having two retaining grooves at two opposite sides respectively forced into engagement with the retaining blocks of the connector, two metal contact plates respectively disposed in contact with the ring and tip contacts of the lamp bulb, and two electrical wires respectively connected to the metal contact plates and extending out of the wire hole of the connector for connection to power supply; a switch mounted on the lamp socket on the outside and disposed inside the connector and connected in series to one of the two electrical wires, having a switching button extending out of the button hole of the connector for switching on/off the electrical circuit of the electrical wires between the lamp bulb and power supply; a barrel sleeved onto the cylindrical front end of the connector, having a front coupling portion mounted in the coupling hole of the lampshade and fixedly secured thereto, and a screw hole in the periphery aimed at the annular groove of the connector; and a tightening up screw threaded into the screw hole of the barrel and forced into engagement with the annular groove of the connector to hold the barrel and the connector together. Because the connector is pivoted to the lamp support, when the fastening device which fixes the connector to the lamp support is loosened, the angle of inclination of the lampshade can be adjusted relative to the lamp support. Furthermore, when the tightening up screw is loosened, the barrel with the lampshade can be turned through 360° relative to the connector.

DETAILED DESCRIPTION OF THE PREFERRED EMBODIMENT

Figure 1:
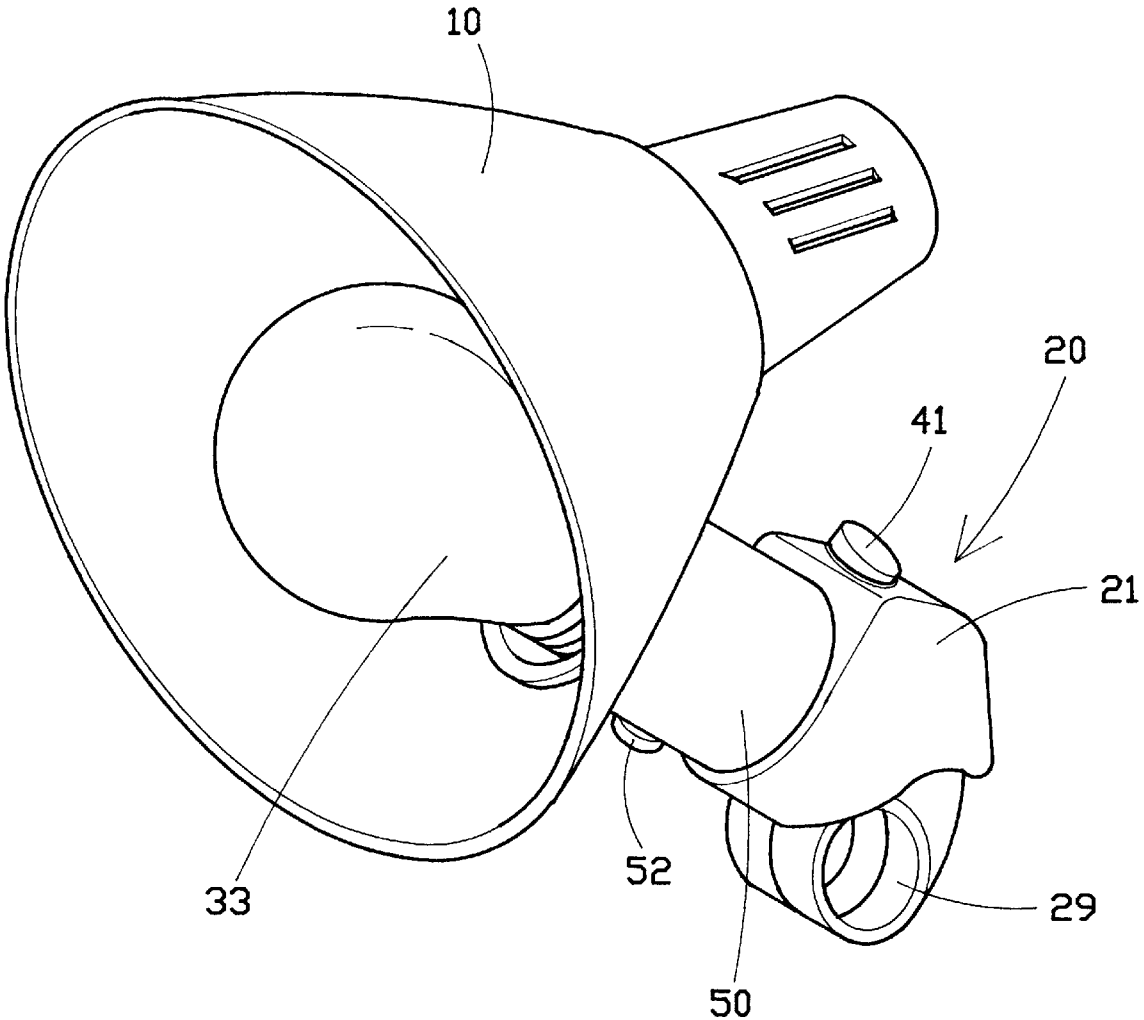
FIG. 1 is an elevational view of a lamp holder assembly according to the present invention.
Figure 2:
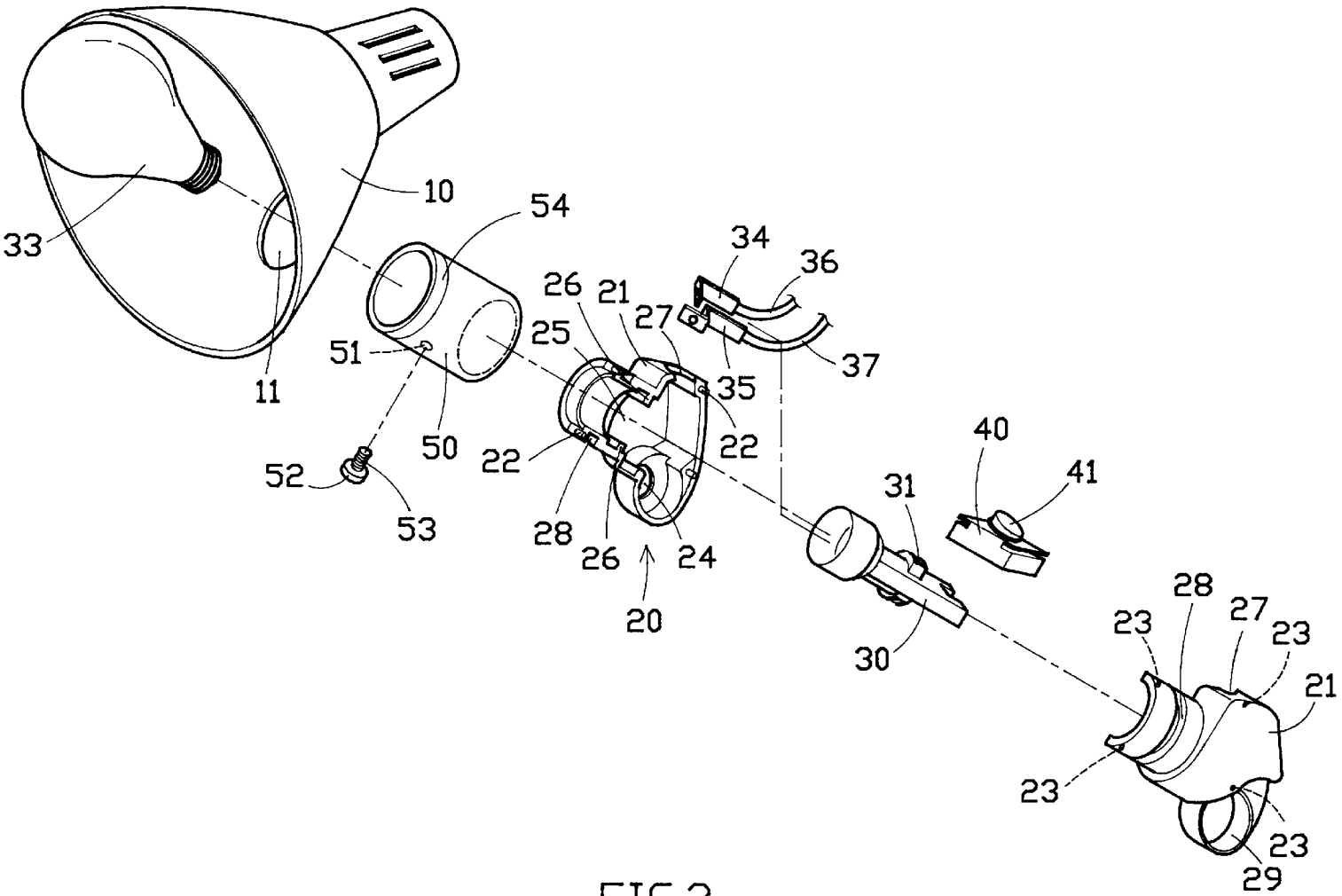
FIG. 2 is an exploded view of the lamp holder assembly shown in FIG. 1.
Figure 3:
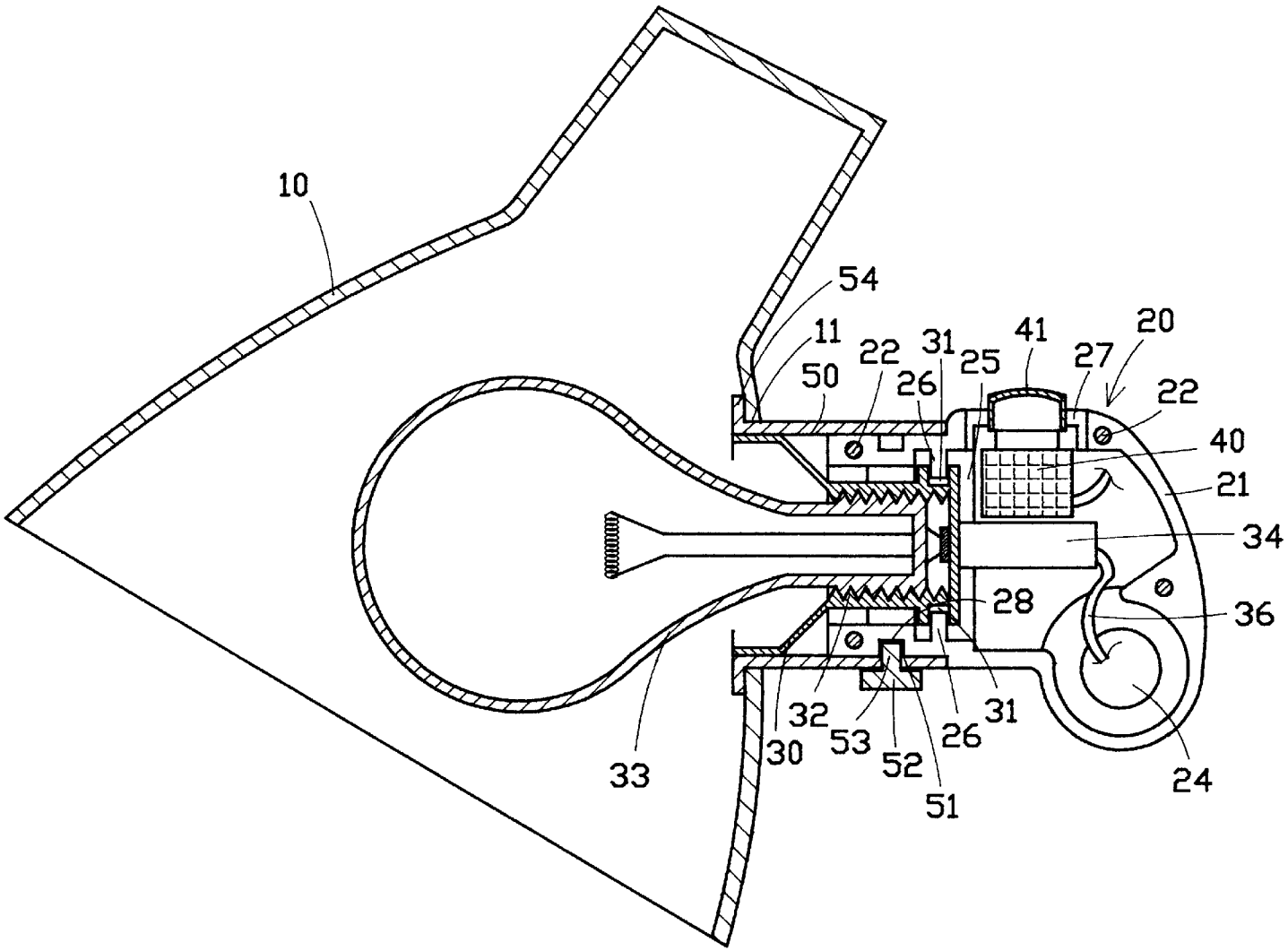
FIG. 3 is a sectional plain view of the lamp holder assembly shown in FIG. 1.

Referring to FIGS. 1, 2, and 3, a lamp holder assembly in accordance with the present invention is generally comprised of a lampshade 10, a connector 20, a lamp socket 30, a switch 40, and a barrel 50. The lampshade 10 has a coupling hole 11 in the periphery. The connector 20 is comprised of two symmetrical half shells 21, which are connected together by fitting respective pins 22 into respective pin holes 23. As illustrated, the connector 20 comprises a mounting hole 24 at the rear end thereof adapted for coupling to for example a lamp support, a lamp socket chamber 25 adapted for holding the lamp socket 30, a wire hole 29 at the rear end adjacent to the mounting hole 24, two retaining blocks 26 disposed inside the lamp socket chamber 25 at different elevations, a button hole 27 at the top side thereof, and an annular groove 28 around the periphery of the cylindrical front end thereof. The lamp socket 30 is mounted in the lamp socket chamber 25 of the connector 20 to hold a lamp bulb 33 outside the connector 20 within the lampshade 10. The lamp socket 30 has two retaining grooves 31 at two opposite sides respectively forced into engagement with the retaining blocks 26 of the connector 20, an inner thread 32 (see FIG. 3) into which the base of the lamp bulb 33 is threaded, a first metal contact plate 34 and a second metal contact plate. 35 mounted on the inside and respectively disposed in contact with the ring contact and tip contact of the base of the lamp bulb 33, and two electric wires 36, 37 respectively connected to the metal contact plates 34, 35 and extending out of the wire hole 29 of the connector 20 for connection to power supply. The switch 40 is mounted on the outside wall of the lamp socket 30 and disposed inside the connector 20 and connected in series to one electrical wire 36, having a switching button 41 inserted out of the connector 20 through the button hole 27. Therefore, the operation of the lamp bulb 33 is controlled by the switching button 41 of the switch 40. The barrel 50 is sleeved onto the cylindrical front end of the connector 20, and has a front coupling portion fixedly coupled to the coupling hole 11 of the lampshade 10, and a screw hole 51 in the periphery aimed at the annular groove 28 of the connector 20. A headed tightening screw 52 is provided having a screw body 53 threaded into the screw hole 51 of the barrel 50 and forced into engagement with the annular groove 28 of the connector 20 to hold the barrel 50 and the connector 20 together. By loosening the headed tightening screw 52, the connector 20 can be turned on its own axis through 360° relative to the barrel 50.

Figure 4:
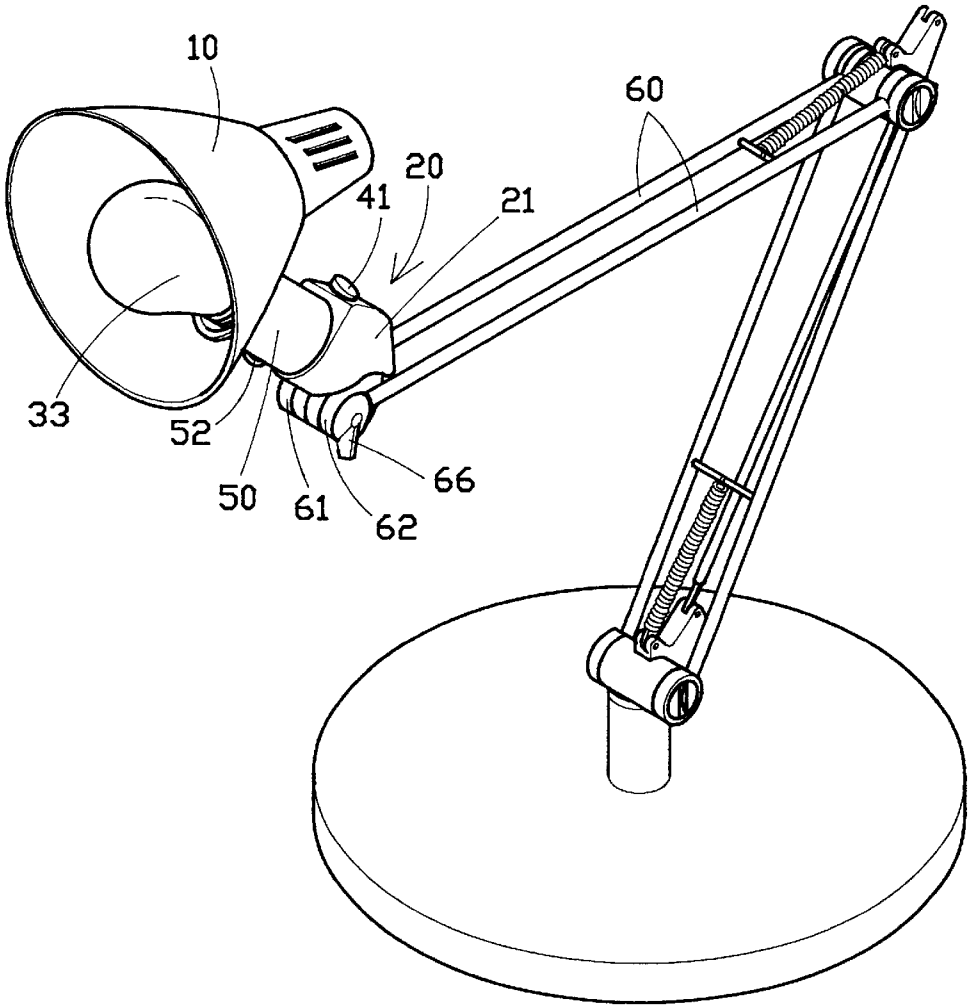
FIG. 4 is an applied view of the present invention, showing the lamp holder assembly mounted on a lamp support.
Figure 5:
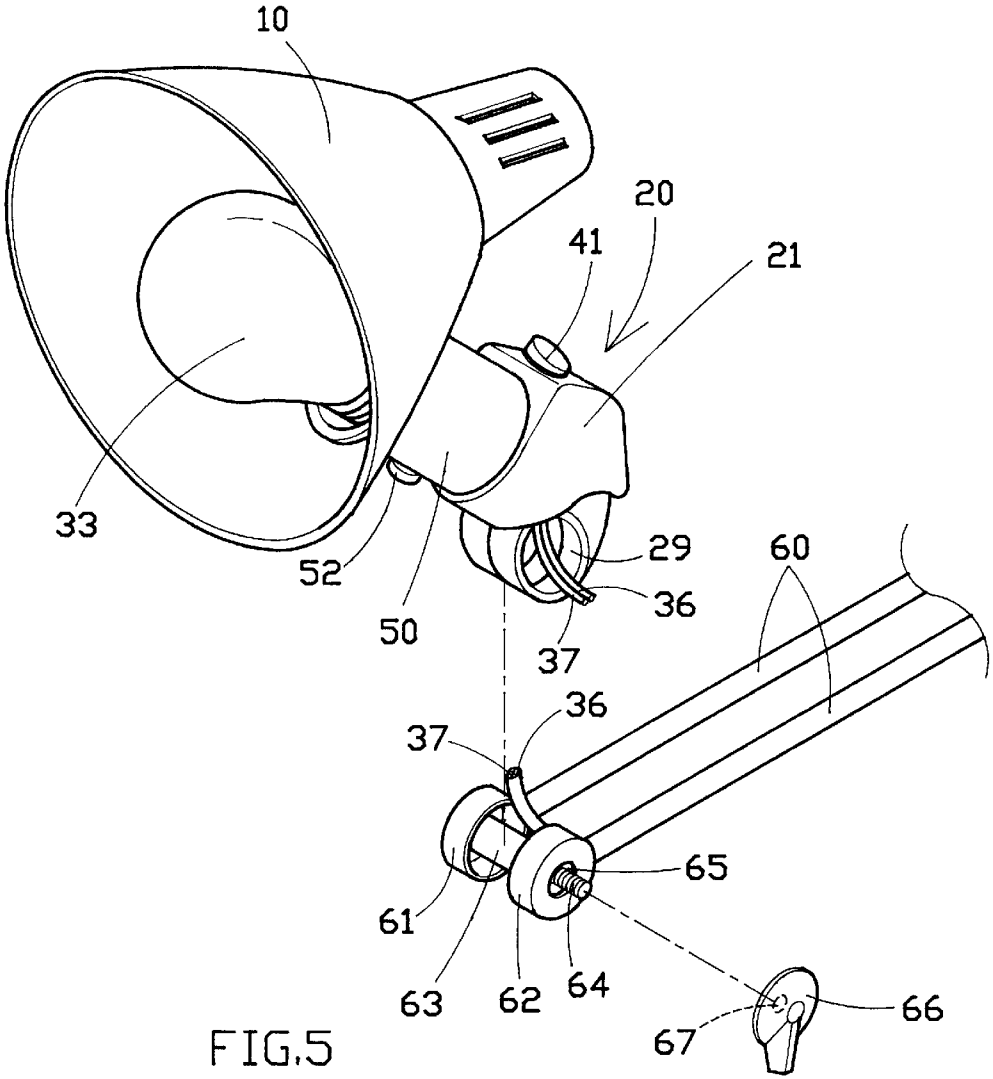
FIG. 5 is an exploded view of FIG. 4.

Referring to FIGS. 4 and 5, the rear end of the connector 20 is coupled to a lamp support 60. The lamp support 60 comprises two bearing blocks, namely, the first bearing block 61 and the second bearing block 62 at the top. The second bearing block 62 has a center through hole 65. The first bearing block 61 has an axle 63 perpendicularly raised from the center of the inner side thereof and inserted through the mounting hole 24 of the connector 20, permitting the connector 20 to be firmly retained between the bearing blocks 61, 62. The axle 63 of the first bearing block 61 terminates in a screw rod 64, which is inserted through the center through hole 65 of the second bearing block 62. A rotary knob 66 is provided having inner threads and is rotated onto the screw rod 64 extending outside the second bearing block 62 to firmly secure the connector 20 in between the bearing blocks 61, 62. By loosening the rotary knob 66, the connector 20 can be turned about the axle 63 to adjust the angle of the lamp holder assembly relative to the lamp support 60.

As stated, when the tightening up screw 52 is loosened, the barrel 50 with the lampshade 10 can be turned through 360° relative to the connector 20 without causing the lamp socket 30 to be rotated or the electrical wires 36, 37 to be twisted. Furthermore, the angle of inclination of the lampshade 10 can be adjusted relative to the lamp support 60 by turning the connector 20 about the axle 63 when the rotary knob 66 is loosened. Because power supply is transmitted to the lamp holder assembly through the electrical wires 36, 37 but not through the lamp support 60, the present invention can be used with a halogen lamp bulb or a regular incandescent bulb.

While only one embodiment of the present invention has been shown and described, it will be understood that various modifications and changes could be made without departing from the spirit and scope of the invention disclosed.

What the invention claimed is:

1. An assembly of a lamp, comprising:

a lampshade member having a coupling hole formed therein;

a longitudinally extended barrel member affixed to said lampshade through said coupling hole, said barrel having a longitudinally directed through bore and a transversely directed threaded hole formed through a wall of said barrel in open communication with said through bore;

a connector formed by a pair of half shells joined together, one of said half shells having a plurality of pins disposed in spaced relationship adjacent a peripheral wall thereof and the other of said pair of half shells having a plurality of corresponding first openings formed therein for respective receipt of said pins, said connector having a connecting portion thereof adapted for insertion into said through bore of said barrel and a second opening extending from said portion to a chamber formed internal said connector, said connector having a mounting hole formed through a rear end portion thereof;

a screw threadedly engaged in said threaded hole of said barrel and contacting said connecting portion of said connector for releasably securing said barrel against rotation relative to said connector;

a lamp socket disposed in said chamber of said connector for receiving a lightbulb through said second opening;

a switch disposed in said chamber above said lamp socket and having an operating button extending through an aperture formed in said connector;

a lamp support having first and second bearing blocks, said first bearing block including an axle extending from a central portion of said first bearing block and terminating in a screw rod, said second bearing block having a centrally disposed opening formed therethrough, said rear end portion of said connector being disposed between said first and second bearing blocks with said axle extending through said mounting hole and said opening in said second bearing block; and, a rotary knob threadedly engaged to said screw rod.

* * * * *